US006774547B1

(12) United States Patent
Zaslavsky et al.

(10) Patent No.: US 6,774,547 B1
(45) Date of Patent: Aug. 10, 2004

(54) DISCHARGE LAMP HAVING A FLUTED ELECTRICAL FEED-THROUGH

(75) Inventors: Gregory Zaslavsky, Marblehead, MA (US); James Avallon, Beverly, MA (US); Joanne Browne, Newburyport, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/606,532

(22) Filed: Jun. 26, 2003

(51) Int. Cl.[7] ..... H01J 1/96; H01J 17/18; H01K 1/22; H01K 1/38

(52) U.S. Cl. ..... 313/285; 313/289; 313/623; 313/574; 140/71.5; 140/71.6

(58) Field of Search ..... 313/285, 289, 313/573, 623, 625, 634, 636, 638, 571, 572, 639, 574; 445/29, 46; 140/71.5, 71.6, 71 R; 439/611; 174/88 R, 93

(56) References Cited

U.S. PATENT DOCUMENTS

| | | | | |
|---|---|---|---|---|
| 3,592,958 A | * | 7/1971 | Munn | 174/88 R |
| 4,531,074 A | | 7/1985 | Nagy et al. | 313/331 |
| 5,455,480 A | | 10/1995 | Bastian et al. | 313/285 |
| 6,075,314 A | | 6/2000 | Huettinger et al. | 313/332 |
| 6,169,366 B1 | | 1/2001 | Niimi | 313/633 |
| 6,313,582 B1 | | 11/2001 | Miyanaga et al. | 313/623 |
| 6,404,130 B1 | | 6/2002 | Dinter | 313/630 |
| 6,583,562 B1 | | 6/2003 | Gobbels | 313/625 |
| 2002/0084754 A1 | | 7/2002 | Allen et al. | 313/623 |

FOREIGN PATENT DOCUMENTS

| | | | |
|---|---|---|---|
| JP | 53-26981 | * | 3/1978 |

* cited by examiner

*Primary Examiner*—Nimeshkumar D. Patel
*Assistant Examiner*—Sharlene Leurig
(74) *Attorney, Agent, or Firm*—Robert F. Clark

(57) ABSTRACT

A fluted feed-through for a discharge lamp includes a fluted ceramic core with plural channels and plural individual molybdenum or tungsten wires running in different ones of the plural channels. The wires are twisted together at the ends of the feed-through. The feed-through is insertable into a capillary tube of a ceramic discharge lamp. The wires of the feed-through have a different thermal coefficient of expansion than the ceramic discharge lamp. The wires are thin enough so that the absolute magnitude of the thermal coefficients of expansion is sufficiently small to prevent seal cracks and leaking.

21 Claims, 4 Drawing Sheets

DISCHARGE LAMP HAVING A FLUTED ELECTRICAL FEED-THROUGH

BACKGROUND OF THE INVENTION

The present invention relates to discharge lamps, in particular to metal-halide discharge lamps.

FIG. 1 shows a conventional metal-halide discharge lamp. The lamp includes a ceramic discharge arc tube 5 with a capillary tube 10 extending from one side of the discharge tube 5. A feed-through 15 is inserted into the capillary tube 10 and sealed with a frit seal 20. The feed-through 15 includes four rod-like components; a tungsten electrode tip 25, a molybdenum coil 30, a cermet (50% Mo, 50% $Al_2O_3$) rod 35, and a niobium rod 40.

The tungsten electrode tip 25 extends into the volume of the discharge tube 5, to function as the discharge termination point. The molybdenum coil 30 is laser welded to the tungsten electrode 25 and extends into the capillary tube 10. The molybdenum coil 30 includes a molybdenum wire wound around a retained molybdenum mandrel. The particular geometry of the molybdenum coil 30 hinders the migration of salts from the fill gas in the discharge tube 5 into the capillary tube without causing excessive heat transfer up the capillary tube 10 from the discharge source.

The electrically conductive cermet rod 35 is laser welded to the other end of the molybdenum coil 30 to provide a material that is both resistant to the fill gases and salts as well as having a coefficient of thermal expansion similar to that of the wall of the capillary tube 10 and the frit seal 20.

Niobium rod 40 is laser welded to the other end of the cermet rod 35 and functions as a material interface between the interior and the exterior of the discharge tube 5 at the end of the capillary tube 10. Part of the niobium rod 40 sticks out of the end of the capillary tube 10.

The frit seal 20 is a solder glass material used to seal the niobium rod 40 to the capillary tube 10 so as to seal the interior of the discharge arc tube 5 from an outside atmosphere. The frit seal 20 extends from the end of the capillary tube 10 between the niobium rod 40 and the capillary tube and into the area where the cermet rod 35 is located. Since niobium is not resistant to the corrosive effects of the discharge tube fill, the frit seal 20 functions not only to seal the discharge tube from atmosphere but also to protect the niobium rod 40 from the discharge tube 5 fill. Niobium has the specific characteristic that its thermal expansion coefficient is very close to that of the alumina that forms the discharge tube 5 and the frit seal 20 to minimize seal cracks and leaks caused by the large temperature variations that can occur when sealing and operating the lamp. These materials each have a thermal coefficient of expansion of about $8\times10^{-6}K^{-1}$. The cermet rod 35 would not be appropriate in the seal location even though it has appropriate thermal expansion characteristics because, unlike niobium, it can develop fissures that can spread and cause leakage of the seal.

The feed-through shown in FIG. 1 requires three laser welds with three different pairs of materials—W to Mo, Mo to cermet, and cermet to Nb. The laser welds must provide intimate contact between the materials and provide good conductivity through the feed-through. The materials must be welded together to provide a straight feed-through that is easily slid into a capillary tube of a discharge lamp. The laser welds must be uniform and smooth so as to avoid burrs and the like that can inhibit passage of the feed-through into the capillary tube. The laser welds must be strong to avoid feed-through breakage during handling and shipping prior to being sealed in the discharge tube. Laser welding equipment is expensive and there are safety issues with its use. The laser set-ups are complicated requiring expensive fixturing with an inert atmosphere at the weld. Although the laser welding process is feasible, it is costly and complicated and one would rather not use laser welding.

In addition to the complications of laser welding, the feed-through contains four different materials, which have to be managed and understood from a material processing, lamp fabrication and lamp operating perspective. The cermet is expensive and its integrity is problematic at high temperatures relative to solid homogeneous refractory materials due to its potential to segregate into its base materials as well as develop fissures. Niobium absorbs hydrogen at low temperatures (<100° C.), oxidizes in air (>200° C.) and readily absorbs hydrogen, oxygen and nitrogen at higher temperatures that causes it to be brittle and to change its thermal expansion characteristics. Further, the niobium is exposed outside the discharge tube, and thus the discharge tube must be used in an atmosphere with which niobium does not react. Niobium also restricts the atmosphere in which the feed-through can be cleaned before manufacturing the discharge tube. For example, high temperature (~1100° C.) wet and dry hydrogen surface cleaning of the feed-through to rid surfaces of carbide and oxides impurities would be possible if not for the presence of the niobium. Additionally, unlike tungsten and molybdenum, niobium is not resistant to the corrosive effects of the discharge tube fill and has to be protected. The niobium puts further constraints on the lamp arrangement because the frit seal must cover the niobium and extend beyond the niobium/cermet weld, which in turn exposes the frit seal to higher temperatures.

In attempts to overcome the problems of the conventional discharge lamp, other high-intensity discharge lamps have been offered. U.S. Pat. No. 4,531,074 to Nagy et al., describes a feed-through for a 250 W high-pressure discharge lamp in which thin strands of molybdenum wire having a diameter of 0.05 mm, and preferably not more than 0.01 mm, are bundled together. The patent teaches that the diameter of the bundle should not exceed 0.15 mm in the case of molybdenum. The bundle is threaded through a bore in an aluminum oxide plug and connected to a tungsten electrode. The bore is sealed with melted vitreous enamel. The bundle is flexible to compensate for the heat expansion of the discharge tube.

U.S. Patent Publication 2002/0084754 to Allen et al. describes a feed-through for a low wattage ceramic metal halide (CMH) lamp with a niobium outer lead welded to an intermediate component comprising a molybdenum overwind on a Mo mandrel. The intermediate component is welded to an electrode comprising a tungsten shank with a W coil wound around one end of the shank. Allen et al. use reduced diameter mandrels with an increased overwind or use multiple overwinds to alleviate thermal expansion stresses that occur between the intermediate component and the ceramic lamp.

FIGS. 2*a* and 2*b* show another conventional discharge lamp such as that taught by U.S. Pat. No. 5,455,480 to Bastian et al. Specifically, FIGS. 2*a* and 2*b* describe a 100 W high-pressure discharge lamp 5*a* with a ceramic sealing element 21, an electrical feed-through 22 and a discharge vessel having cylindrical ends 6 through which the feed-through 22 extends. The feed-through 22 is made of alumina with metal wires threaded therethrough. The feed-through 22 is formed with at least two thin wires 23 having a diameter of about 0.25 mm. The wires 23 that extend into the interior of the discharge vessel are twisted together to form an electrode tip 25'. The wires in the cylindrical ends are either loosely bundled and surrounded by glass melt or individual wires 23 are fed through a plurality of bores in a ceramic plug and then surrounded by glass melt 29. The number of wires determines the current rating of the lamp. Bastian et al. also teach a lead wire connection extending outside of a capillary tube. The lead wire connection end of Bastian et al. is complicated requiring a niobium closing portion 28 and a niobium wound portion 27 in addition to a glass melt seal 29.

These lamps have problems specific to the particular design choice. The bores of both Nagy et al. and Bastian et al. must be sealed in addition to the seal required at the end of the capillary. In addition, the bores themselves must be formed in the plug (aluminum plug of Nagy et al. and ceramic plug in Bastian et al.). In Nagy et al., a bore must also be formed in the tungsten electrode. The wires of Nagy are also very thin having a maximum diameter of 0.01 mm for molybdenum. The lead wire connection end of Bastian et al. is difficult to produce requiring a niobium closing portion and a niobium spiraled portion in addition to the glass melt seal.

SUMMARY OF THE INVENTION

It is an object of the present invention to provide a feed-through and a discharge lamp free of the above-mention problems.

Specifically, an object of the present invention is to prevent seal cracks and leaking due to differences in thermal expansion coefficients of the components of the discharge lamp.

Another object is to provide a feed-through for a discharge lamp that has plural spaced apart feed-through wires that are sufficiently small so that an absolute magnitude of a difference between the thermal expansion of each individual wire and a seal of the lamp is sufficiently small for each wire so as to avoid cracks in the seal while a sufficient number of the wires is provided to meet the lamp's power requirements.

Yet another object is to provide a discharge lamp that is simpler and cheaper to produce.

Still another object is to reduce the number of components of the feed-through.

Still yet another object is to reduce the amount of high precision laser welding that needs to be performed.

These and other objects are achieved by providing a feed-through having a ceramic core with a plurality of grooves along its outside length and wires in the grooves. The wires are twisted together at least at one end of the feed-through. The twisted wire may be used as the electrode inside the lamp or a separate electrode tip may be attached to the twisted wire bundle.

BRIEF DESCRIPTION OF THE DRAWINGS

Other objects and characteristics of the invention will become more apparent from the description given in further detail below with reference to the accompanying drawings in which:

FIG. 1 is a partial schematic view of a conventional discharge lamp and feed-through;

DETAILED DESCRIPTION OF PREFERRED EMBODIMENTS

Figure 3:
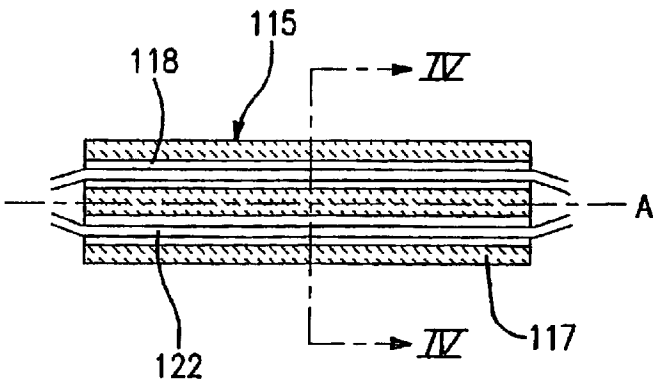
FIG. 3 is a side view of a feed-though according to the present invention.
Figure 4:
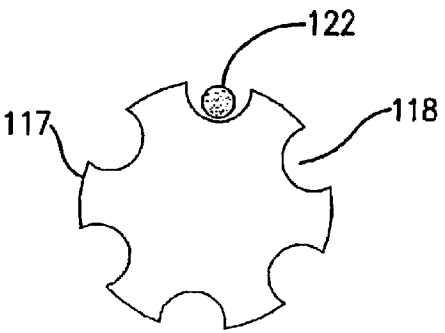
FIG. 4 is a cross-sectional view of the feed-through of FIG. 3.

With reference now to FIGS. 3 through 6, an electrical feed-through 115 for a discharge lamp of the present invention includes an elongate ceramic core 117 having a plurality of grooves 118 extending in a longitudinal direction in an exterior surface thereof As seen in FIG. 4, this gives the core 117 a fluted appearance. Each of the grooves 118 receives an electrically conductive wire 122 (only one wire is shown in FIG. 4 for clarity). The wires 122 extend beyond the ends of core 117. The parts of the wires 122 that extend beyond the ends of core 117 are twisted together (at least at one end) to form twisted wire bundles at ends of the feed-through 115. The feed-through 115 is insertable into a capillary tube 110 (see FIGS. 5–6) of a discharge lamp 105 so that one bundle of twisted wire 124 is inside the discharge lamp 105 and another bundle of twisted wire 126 is outside the capillary tube 110. A lead wire (not shown) can be attached to the twisted wire bundle 126 outside the capillary tube 110. Based on the above design, the feed-through 115 can be manufactured off-site and readily inserted into an existing capillary tube. Twisting the ends of the wires together creates sufficient tension on the wires to keep the wires on the core as a complete compact feed-through unit that can be manufactured off-site and be packaged without damage to or separation of the feed-through.

Figure 5:
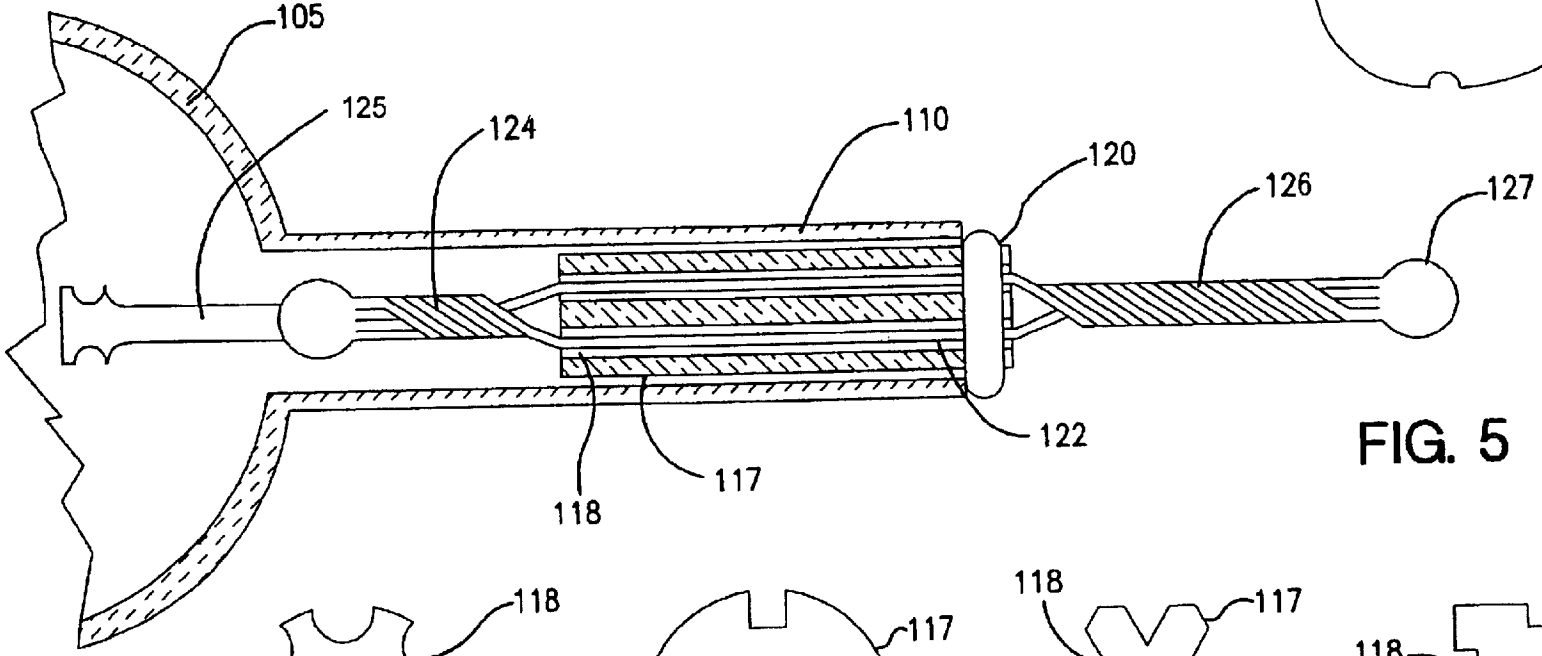
FIG. 5 is a partial schematic view of a first embodiment of a feed-though according to the present invention in a discharge lamp.

The wires 122 may be molybdenum or tungsten and have a diameter of up to about 0.25 mm, preferably 0.18 mm to 0.23 mm. The wires 122 in the grooves 118 may be separate wires or one or more wires may be folded back at the twisted wire bundles 124, 126 so that the-same wire extends in more than one groove 118. The number of wires depends on the power requirements of the lamp. The twisted wire bundle 124 inside the discharge lamp 40 may be the electrode or an electrode tip 125 may be attached, such as by welding, to the bundle 124 as seen in FIG. 5. The electrode tip 125 may be tungsten, for example. In an embodiment of the present invention suitable for a 400W lamp, six 0.20 mm diameter wires are cumulatively of such a cross-sectional area that the wires can carry sufficient current through the feed-through for the 400W lamp. In this embodiment, the grooves have a diameter of 0.25 mm. Each groove may contain one wire, or may include several wires whose total diameter still fits within the groove.

The core 117 may be an elongate ceramic rod, such as an alumina rod, and have two or more of the grooves 118, preferably six, extending the longitudinal length of the core 117 so as to leave sufficient material to maintain the structural integrity of the core 117 after the grooves 118 have been formed and to provide grooves 118 for enough wires 122 to meet the power needs of the lamp. Not only are the grooves 118 easier to form in the core than the bores of the prior art, but it is also easier to lay the wires in the grooves than to thread the wires through the bores. The core 117 has a length similar to the length of the capillary tube 110 and has a diameter smaller than the capillary tube 110 to be able to slide into the capillary tube 110 when the lamp is being manufactured. However, as is known in the art, the inside diameter of the tube and the outside diameter of the feed-through are closely matched to optimize a seal at the capillary tube and to prevent the migration and collection of fill gas salts into the capillary tube and toward the seal. In a preferred embodiment, the rod has a diameter of about 1.3 mm±0.03 mm. The grooves 118 should be deep enough so that the wires 122 do not protrude beyond the periphery of the core 117.

Figure 4E:
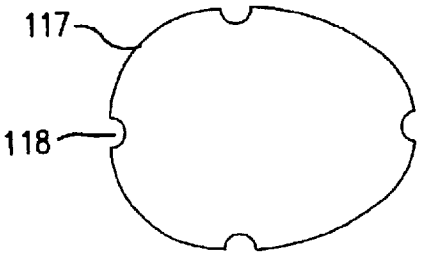
FIGS. 4A, 4B, 4C, 4D and 4E are cross-sectional views of various embodiments of a core of a feed-through according to the present invention.
Figure 4D:
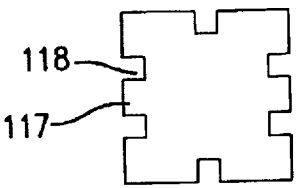
Figure 4C:
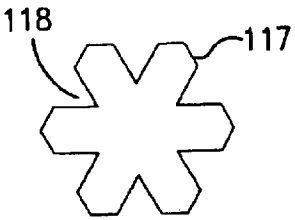

As seen in FIGS. 3 and 4, the grooves 118 of the rod 117 are fluted or rounded and are parallel to a longitudinal axis A of the rod 117. The grooves 118 are evenly spaced about the axis A. However, the grooves could spiral longitudinally about the rod 117 and do not need to be parallel to each other or evenly spaced. Accordingly, any shaped groove is contemplated as long as the wire fits within the groove. See for example FIGS. 4A–4C. However, the wire does not need to be entirely within the groove and may partially extend beyond the groove, such as when pushed out by frit material feeding under the wire during assembly of the discharge lamp.

Figure 4B:
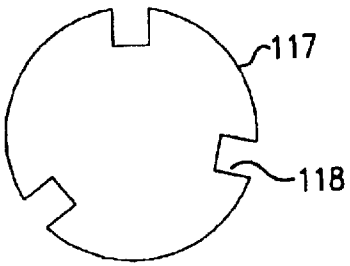
Figure 4A:
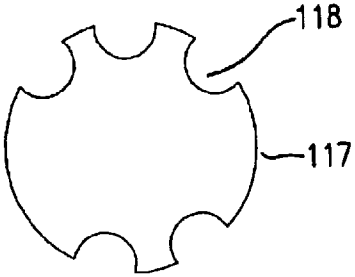

As also seen in FIGS. 4A and 4B, the rod 117 is preferably substantially cylindrical, however rods with hexagonal, rectangular, or oval cross sections are also contemplated. See FIGS. 4C, 4D and 4E. The particular embodiment of FIG. 5 is suitable for a 400W high intensity discharge (HID) ceramic lamp. However, the feed-through of the present invention is applicable to many different wattages and configurations of HID ceramic lamps or metal-halide lamps with ceramic envelopes.

The feed-through extends through the capillary tube 110 of a discharge lamp. In such lamps, the lamp and capillary tube are a ceramic, preferably alumina. In one embodiment, the lamp has a bulged central part and elongate capillary tubes extending from each end. The feed-through 115 of the present invention is in each capillary tube. An electrode at one end of the feed-through extends into the bulged central part of the lamp and provides a discharge arc. The other end of the feed-through 115 extends outside of the capillary tube and is sealed off using seals that are known in the art and are preferably the same material as the lamp.

The materials of construction of the lamp and the seal do not need to be the same, however, the thermal coefficients of expansion of these materials should be similar. The thermal coefficient of expansion of a preferred ceramic of the core 117, alumina ($Al_2O_3$) is $8\times10^{-6}K^{-1}$. The core 117 is desirably the same material, or nearly the same material, as the capillary tube so that differences in thermal coefficients of expansion is not an issue. Using a seal that is substantially the same as the prior art allows the feed-through of the present application to be readily introduced into existing discharge lamp production.

In accordance with a feature of the invention, the wires 122 are metal having thermal coefficients of expansion of about 4 to $5\times10^{-6}K^{-1}$ which is about half that of the alumina. These wires are thin enough and spaced apart in the grooves so that, even though there are substantial differences in the thermal coefficients of expansion between the individual wires and the alumina, the absolute magnitude of the thermal expansion difference for each groove/wire combination is small enough so as to be negligible. Specifically, at the seal surface, individual wires are separately contacting the seal surface so that the thermal expansion difference is small enough so as to be negligible. Thus, the differences in the thermal coefficients of expansion do not cause seal cracks and leaking. In the prior art, plural wires may be twisted or braided together at the seal surface, so that the plural wires have a cumulative effect on the thermal coefficients of expansion thus increasing the absolute magnitude of the thermal expansion difference for the plural wires and may cause seal cracks or leaks.

The feed-through 115 is slid through and extends in a capillary tube 110 of a discharge lamp 105. The discharge lamp 105 of FIG. 5 is a 400W HID ceramic lamp. Only one side of the discharge lamp 105 is shown. Those of ordinary skill in the art would understand that a second capillary tube 110 extends from the other side of the discharge lamp 105 in a mirror image with a second feed-through 115.

As seen in FIG. 5, the end of the feed-through 115 having the electrode 125, extends from the capillary tube 110 into the bulged central region of the discharge lamp 105. A stop wire or other device known to those in the art prevents the feed-through 115 from sliding into the arc tube volume of the lamp 105. As known in the art, the feed-through rests at the edge of the capillary to provide a proper gap between electrodes for generating an arc. The other end of the feed-through 115 having the lead attachment point 127 extends out beyond the capillary tube 110. A seal 120 (shown unheated in FIG. 5) such as a donut-shaped frit ring, known to those in the art and preferably of a material with the same thermal expansion coefficient as the discharge lamp, seals the feed-through inside the capillary. Accordingly, the feed-through not only provides a lead attachment point 127, but also provides a core for the seal to be held adjacent to the capillary tube in preparation for sealing.

Figure 6:
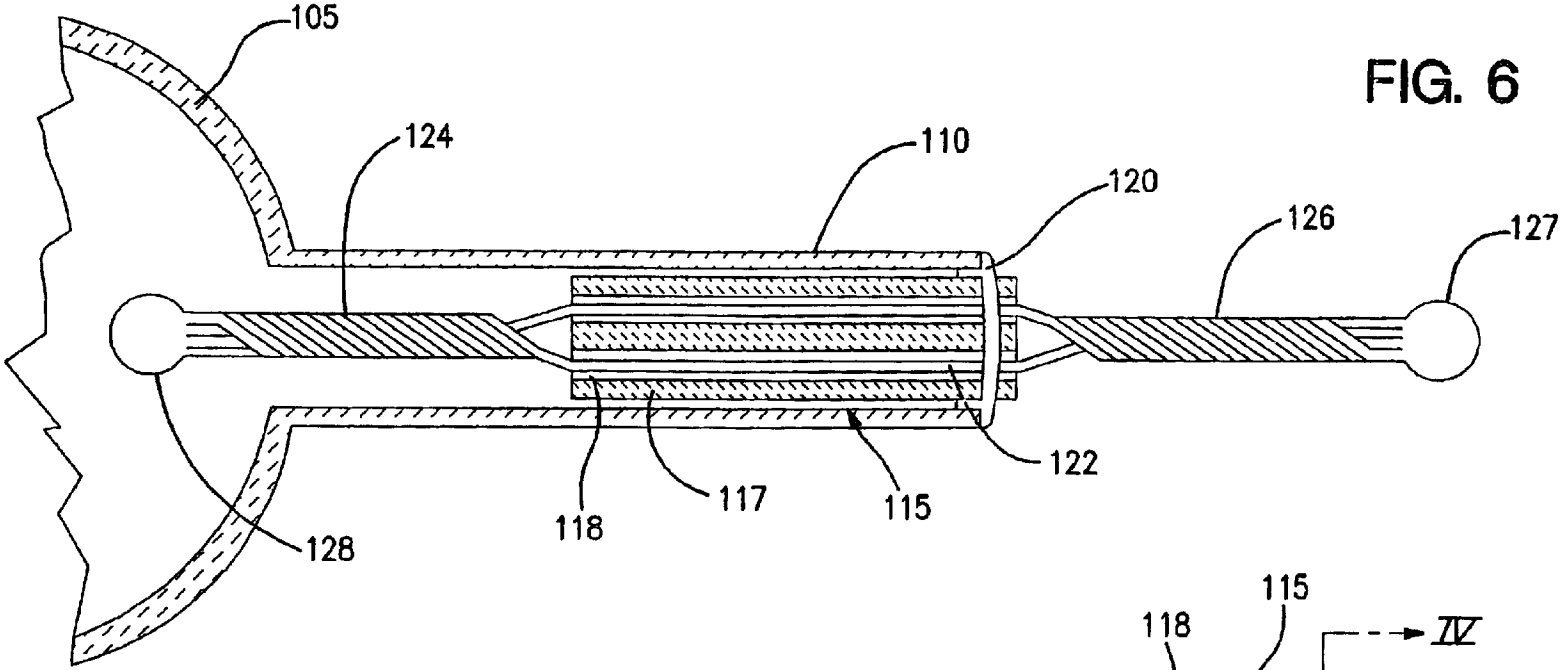
FIG. 6 is a partial schematic view of a second embodiment of a feed-through according to the present invention in a discharge lamp.

In a second embodiment as seen in FIG. 6, the wires 122 in the grooved core alumina rod 117 are tungsten and are twisted together at one end of the feed-through to form the attachment point 127 for the lead wire. However, since the wires 122 are tungsten, the wires themselves are twisted together at the other end to form an electrode tip 128. A separate tungsten electrode does not need to be welded at the other end of the wires as shown in the embodiment in FIG. 5.

The molybdenum or tungsten wires 122 of FIGS. 5 and 6 are thin enough and are spaced apart in the grooves so that, even though there are substantial thermal coefficients of expansion differences between Mo/W and the alumina/frit material, the absolute magnitude of the thermal coefficients of expansion for each wire/groove is small enough so as to be negligible. Thus the differences in the thermal coefficients of expansion do not cause seal cracks and leaking.

The present invention takes advantage of the general property that the thinness of the Mo or W wires and their separation into separate grooves will mitigate the problems of thermal expansion differences with alumina and frit material. Accordingly, the number of feed-through materials is reduced so that just alumina and W are used in the one embodiment and alumina, Mo and W are used in another embodiment. As noted above, use of alumina does not present any problems of thermal expansion differences because the discharge tube is the same material.

The prior art uses more components for the feed-through than the present invention. In addition to the Mo and W, the prior art also uses Nb and possibly cermet. Each of the additional components in the prior art requires additional welds and processing steps to connect the components together. One embodiment of the present invention has no laser welds and another embodiment has only one laser weld. The one laser weld is a relatively simple weld where a set of wires are twisted, heated and balled together before welding to a tungsten electrode.

Figure 1:
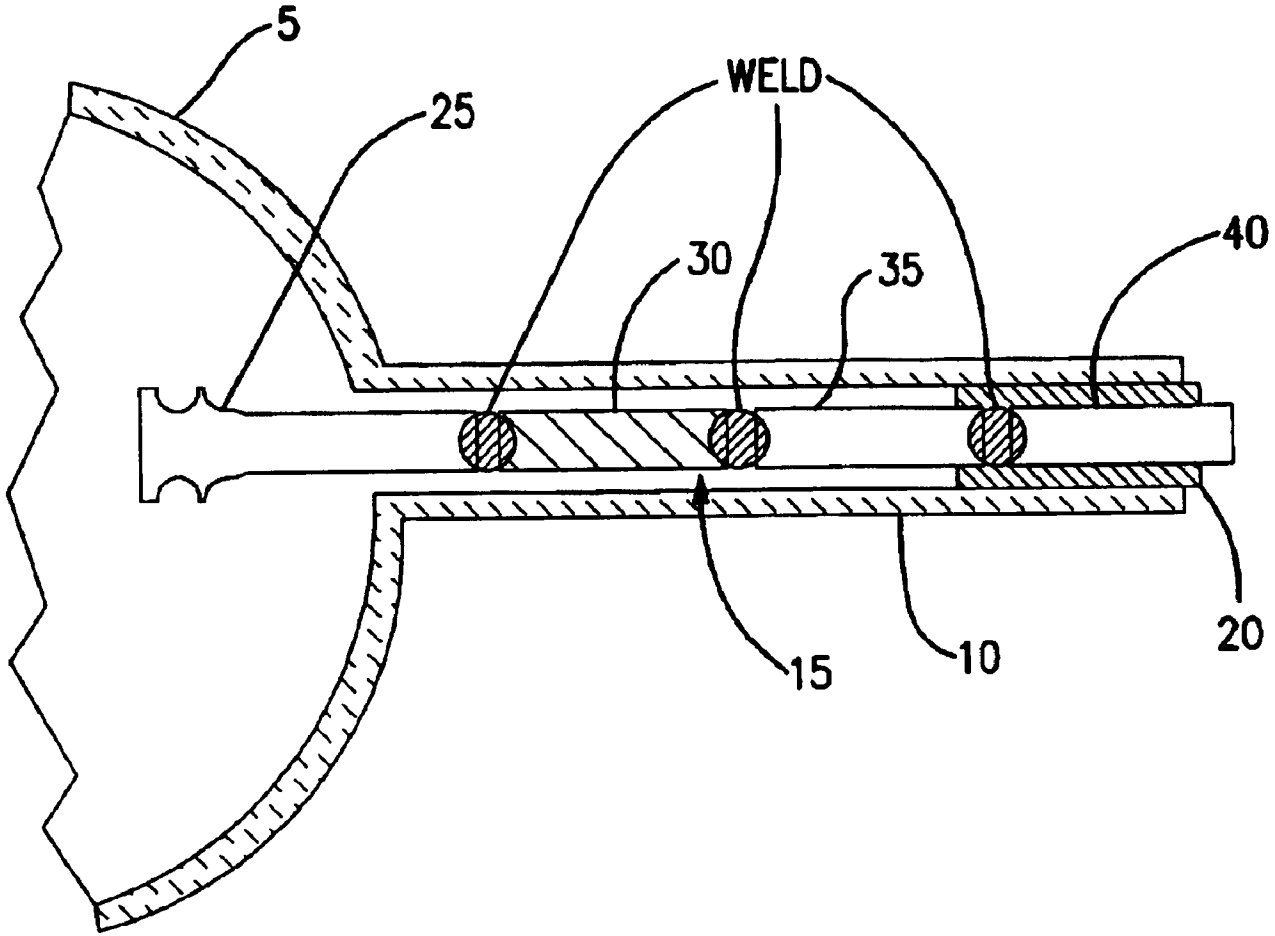
FIG. 1 PRIOR ART
Figure 2A:
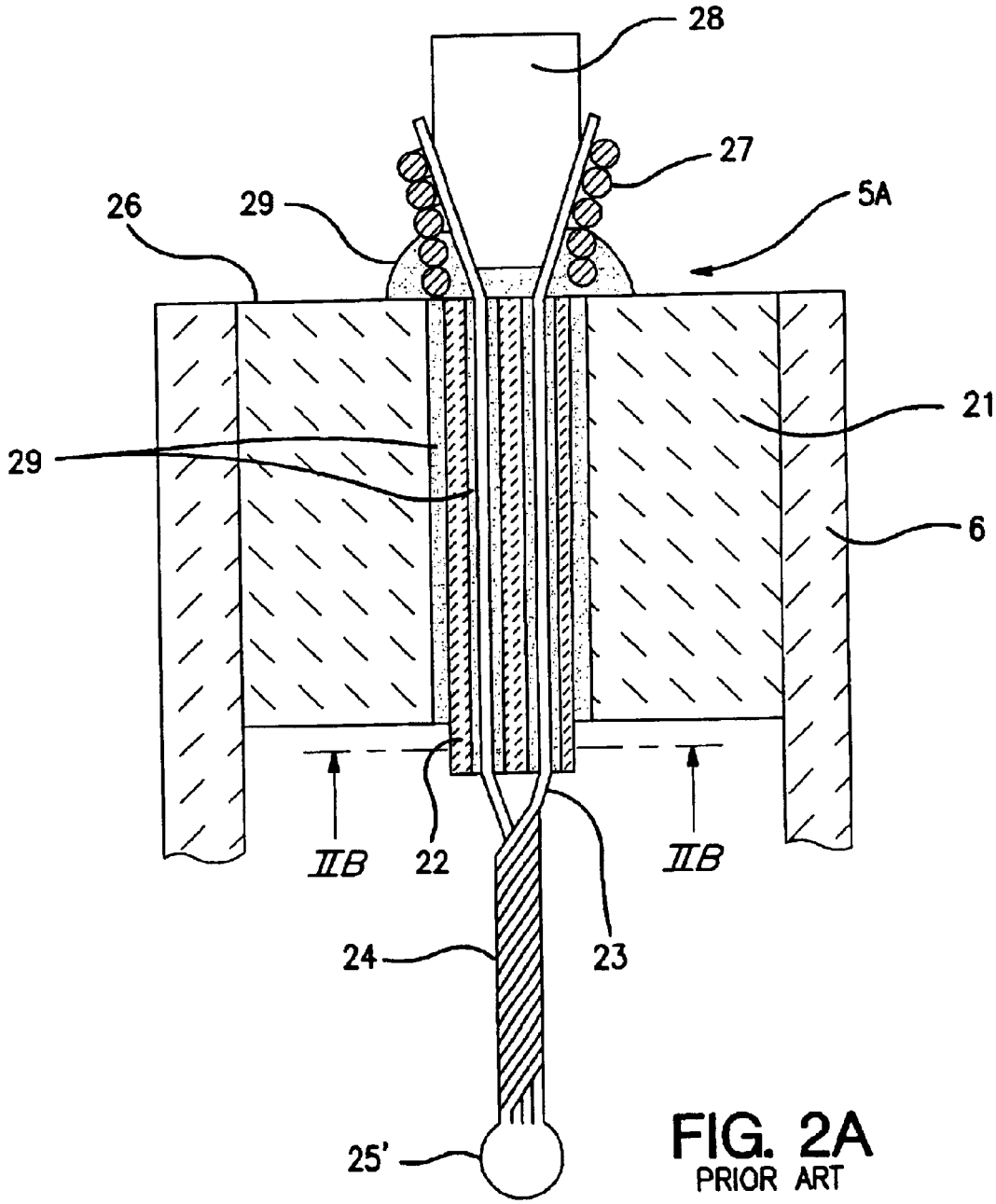
FIG. 2A PRIOR ART
FIGS. 2*a* and 2*b* are a partial schematic view and a cross-sectional view, respectively of a feed-through of another conventional discharge lamp.
Figure 2B:
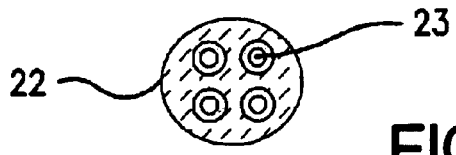
FIG. 2B PRIOR ART

Another advantage of the present invention is that all of the materials of the feed-through are resistant to corrosion by the fill gas. The prior art requires a minimum and consistent frit seal length to protect the Nb from the corrosive effects of the fill gas. Since the feed-through of the present invention is resistant to the corrosive effects of the fill gas, the seal of the present invention is only functioning as a seal and not also as a protective layer. The seal can therefore be shorter (compare the heated seal along seal lengths of FIGS. 1 and 6) which places the seal further away from the source of heat in the discharge volume so that the seal is not exposed to as high temperatures as the seal in the prior art. This is advantageous because the seal is more corrosion resistant at lower temperatures.

In the prior art, the interface material at the seal, exposed to the lamp jacket atmosphere, and attached to the lead wire is niobium, which is susceptible to embrittlement and thermal expansion changes due to its absorption and reactivity properties. The present invention avoids these problems by the interface materials and exposed materials being Mo or alumina, which are less reactive than Nb. Therefore, the discharge tube or arc tube can be operated in outer jacket atmospheres other than inert. Since Nb is not used in the present invention, the feed-through surface can also be cleaned with wet and dry hydrogen at high temperatures before lamp processing. This cleaning process is more effective than the process used in the prior art wherein the feed-through is cleaned in vacuum. The prior art cleaning process is not as effective for cleaning the surface of carbon-bearing and oxide-bearing surface residual properties. In addition, the construction of the feed-through is much simpler, allowing the feed-through to be manufactured off-site and then readily inserted into an existing capillary tube without an expensive retooling of the process machinery.

While the invention has been described with reference to the particular illustrative embodiments, it is not to be restricted by those embodiments but only by the appended claims. It is to be appreciated that those having ordinary skill in the art can change or modify the embodiment without departing from the scope and spirit of the invention.

What is claimed is:

1. An electrical feed-through for a discharge lamp, comprising:

an elongate ceramic core having a plurality of grooves extending in a longitudinal direction in an exterior surface of said core; and a plurality of separate electrically conductive wires each extending in a different one of said plural grooves, ends of each of said plural wires extending beyond ends of said core and at least one of said ends of said plural wires extending beyond the same end of said core being twisted together.

2. The electrical feed-through as claimed in claim 1, wherein said plural wires are one of molybdenum and tungsten.

3. The electrical feed-through as claimed in claim 2, wherein said plural wires are molybdenum, and wherein said plural wires are twisted at one of said ends and are attachable to a lead wire.

4. The electrical feed through as claimed in claim 1, wherein said core is alumina.

5. The electrical feed through as claimed in claim 4, wherein said plural wires each have a diameter of up to about 0.25 mm.

6. The electrical feed through as claimed in claim 1, wherein said plural grooves number six.

7. A discharge lamp comprising:

a discharge tube;

a capillary extending from at least one end of said discharge tube;

an elongate ceramic core within said capillary having a plurality of grooves extending in a longitudinal direction in an exterior surface of said core and a plurality of separate wires each extending in a different one of said plural grooves, ends of each of said plural wires extending beyond ends of said ceramic core, the ends of each wire extending beyond the same end of said core being twisted together;

an electrode at a first end of said plural wires extending into said discharge tube; and a seal at one end of said capillary.

8. The high intensity discharge lamp as claimed in claim 7, wherein said core is alumina and has six grooves.

9. The high intensity discharge lamp as claimed in claim 7, wherein said plural wires are selected from molybdenum and tungsten.

10. The high intensity discharge lamp as claimed in claim 7, wherein a part of said core extends outside said capillary, and wherein the seal comprises a donut-shaped frit surrounding said part of said core that extends out of said capillary.

11. The high intensity discharge lamp as claimed in claim 7, wherein said electrode is a tungsten electrode connected to said first end.

12. The high intensity discharge lamp as claimed in claim 7, wherein said plural wires are tungsten and said plural wires twisted at said first end are said electrode.

13. The high intensity discharge lamp as claimed in claim 7, wherein said discharge tube is a high intensity discharge (HID) ceramic tube.

14. The high intensity discharge lamp as claimed in claim 7, wherein said discharge tube and said core have substantially the same coefficient of thermal expansion, and wherein the coefficient of thermal expansion of said plural wires is about one half of the coefficient of the thermal expansion of said core.

15. The high intensity discharge lamp as claimed in claim 7, wherein said core is generally cylindrical and said plural grooves are evenly spaced around a circumference of said core.

16. A feed-through comprising:

a fluted ceramic core having plural channels; and a plurality of individual tungsten wires that are each in a different one of said plural channels, each end of said plural wires extending beyond a first end of the core being twisted together to form an electrode tip.

17. The feed-through as claimed in claim 16, wherein the plural channels number six and are parallel to each other about a longitudinal axis of the core.

18. The feed-through as claimed in claim 16, wherein the plural wires each have a diameter of up to about 0.25 mm.

19. The electrical feed-through of claim 1 wherein of claim 1 wherein the core has a hexagonal, rectangular, or oval cross section.

20. The discharge lamp of claim 7 wherein the core has a hexagonal, rectangular, or oval cross section.

21. The feed-through of claim 16 wherein the core has a hexagonal, rectangular, or oval cross section.

* * * * *